US006336506B2

(12) United States Patent
Wesson

(10) Patent No.: US 6,336,506 B2
(45) **Date of Patent: *Jan. 8, 2002**

(54) APPARATUS AND METHOD FOR PERFORATING AND STIMULATING A SUBTERRANEAN FORMATION

(75) Inventor: David S. Wesson, DeSoto, TX (US)

(73) Assignee: Marathon Oil Company, Findlay, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/735,963

(22) Filed: Dec. 12, 2000

Related U.S. Application Data

(63) Continuation of application No. 09/110,728, filed on Jul. 6, 1998, now Pat. No. 6,158,511, which is a continuation-in-part of application No. 08/711,188, filed on Sep. 9, 1996, now Pat. No. 5,775,426.

(51) Int. Cl.[7] ..... E21B 43/17

(52) U.S. Cl. ..... 166/308; 166/55.1; 166/297; 175/4.6

(58) Field of Search ..... 166/55, 55.1, 297, 166/308; 175/4.5, 4.54, 4.6, 4.58

(56) References Cited

U.S. PATENT DOCUMENTS

| | | | | |
|---|---|---|---|---|
| 3,029,732 | A | 4/1962 | Greene | 102/21.6 |
| 3,064,733 | A | 11/1962 | Bourne, Jr. | 166/55 |
| 3,366,188 | A | 1/1968 | Hicks | 166/297 |
| 3,376,375 | A | 4/1968 | Porter | 175/4.58 |
| 3,952,832 | A | 4/1976 | Elmore et al. | 181/116 |
| 4,039,030 | A | 8/1977 | Godfrey et al. | 166/299 |
| 4,148,375 | A | 4/1979 | Dowler et al. | 181/117 |
| 4,191,265 | A | 3/1980 | Bosse-Platiese | 175/4.6 |
| 4,253,523 | A | 3/1981 | Ibsen | 166/299 |
| 4,391,337 | A | 7/1983 | Ford et al. | 175/4.6 |
| 4,502,550 | A | 3/1985 | Ibsen | 166/297 |
| 4,541,486 | A | 9/1985 | Wetzel et al. | 166/297 |
| 4,598,775 | A | 7/1986 | Vann et al. | 175/4.6 |
| 4,633,951 | A | 1/1987 | Hill et al. | 166/63 |
| 4,683,943 | A | 8/1987 | Hill et al. | 166/63 |
| 4,711,302 | A | 12/1987 | Jennings, Jr. | 166/250 |
| 4,798,244 | A | 1/1989 | Trost | |
| 4,823,875 | A | 4/1989 | Hill | 166/280 |
| 4,823,876 | A | 4/1989 | Mohaupt | 166/299 |
| 5,005,641 | A | 4/1991 | Mohaupt | 166/63 |
| 5,355,802 | A | 10/1994 | Petitjean | 102/313 |
| 5,421,418 | A | 6/1995 | Nelson et al. | 166/297 |
| 5,598,891 | A | 2/1997 | Snider et al. | 166/308 |

OTHER PUBLICATIONS

*Journal of Petroleum Technology*, "Technology Digest; High–Energy–Gas Well Stimulation," Feb. 1998, pp. 16 and 83.

Haney et al., "The Application of an Optimized Propellant Stimulation Technique in Heavy Oil Wells," SPE 37531, 1997, pp. 173–182.

*Primary Examiner*—Frank Tsay
(74) *Attorney, Agent, or Firm*—Jack E. Ebel

(57) ABSTRACT

A method and apparatus for perforating and stimulating a subterranean formation which is penetrated by a well bore having casing positioned therein so as to establish fluid communication between the formation and the well bore. Substantially rigid, flexible, or liquid propellant is interposed between the casing and at least one shaped charge in a subterranean well bore and is ignited due to the shock, heat and/or pressure generated from the detonated charge. Upon burning, the propellant material generates gases which clean perforations formed in the formation by detonation of the shaped charge(s) and which extend fluid communication between the formation and the well bore.

30 Claims, 12 Drawing Sheets

APPARATUS AND METHOD FOR PERFORATING AND STIMULATING A SUBTERRANEAN FORMATION

CROSS-REFERENCE TO RELATED APPLICATIONS

This application is a continuation of U.S. patent application, Ser. No. 09/110,728, filed Jul. 6, 1998 and now U.S. Pat. No. 6,158,511, which is a continuation-in-part of U.S. patent application, Ser. No. 08/711,188, filed Sep. 9, 1996 and now U.S. Pat. No. 5,775,426.

BACKGROUND OF THE INVENTION

1. Field of Invention

The present invention relates to an apparatus and method for perforating well casing and/or a subterranean formation (s), and more particularly, to such an apparatus and process wherein a propellant is employed to substantially simultaneously enhance the effectiveness of such perforations and to stimulate the subterranean formation(s).

2. Description of Related Art

Individual lengths of relatively large diameter metal tubulars are secured together to form a casing string which is positioned within a subterranean well bore to increase the integrity of the well bore and provide a path for producing fluids to the surface. Conventionally, the casing is cemented to the well bore face and subsequently perforated by detonating shaped explosive charges. These perforations extend through the casing and cement a short distance into the formation. In certain instances, It is desirable to conduct such perforating operations with the pressure in the well being overbalanced with respect to the formation pressure. Under overbalanced conditions, the well pressure exceeds the pressure at which the formation will fracture, and therefor, hydraulic fracturing occurs in the vicinity of the perforations. As an example, the perforations may penetrate several inches into the formation, and the fracture network may extend several feet into the formation. Thus, an enlarged conduit can be created for fluid flow between the formation and the well, and well productivity may be significantly Increased by deliberately inducing fractures at the perforations.

When the perforating process is complete, the pressure within the well is allowed to decrease to the desired operating pressure for fluid production or injection. As the pressure decreases, the newly created fractures tend to close under the overburden pressure. To ensure that fractures and perforations remain open conduits for fluids flowing from the formation into to the well or from the well into the formation, particulate material or proppants are conventionally injected into the perforations so as to prop the fractures open. In addition, the particulate material or proppant may scour the surface of the perforations and/or the fractures, thereby enlarging the conduits created for enhanced fluid flow. The proppant can be emplaced either simultaneously with formation of the perforations or at a later time by any of a variety of methods. For example, the lower portion of the wellbore can be filled with a sand slurry prior to perforation. The sand is subsequently driven into the perforations and fractures by the pressured fluid in the wellbore during conventional overbalanced perforating operations.

As the high pressure pumps necessary to achieve an overbalanced condition in a well bore are relatively expensive and time consuming to operate, gas propellants have been utilized in conjunction with perforating techniques as a less expensive alterative to hydraulic fracturing. Shaped explosive charges are detonated to form perforations which extend through the casing and into the subterranean formation and a propellant is ignited to pressurize the perforated subterranean interval and propagate fractures therein. U.S. Pat. Nos. 4,633,951, 4,683,943 and 4,823,875 to Hill et al. describe a method of fracturing subterranean oil and gas producing formations wherein one or more gas generating and perforating devices are positioned at a selected depth in a wellbore by means of by a section of wireline which may also be a consumable electrical signal transmitting cable or an ignition cord type fuse. The gas generating and perforating device is comprised of a plurality of generator sections. The center section includes a plurality of axially spaced and radially directed perforating shaped charges which are interconnected by a fast burning fuse. Each gas generator section includes a cylindrical thin walled outer canister member. Each gas generator section is provided with a substantially solid mass of gas generating propellant which may include, if necessary, a fast burn ring disposed adjacent to the canister member and a relatively slow bum core portion within the confines of ring. An elongated bore is also provided through which the wireline, electrical conductor wire or fuse which leads to the center or perforating charge section may be extended. Primacord fuses or similar igniters are disposed near the circumference of the canister members. Each gas generator section is simultaneously ignited to generate combustion gasses and perforate the well casing. The casing is perforated to form apertures while generation of gas commences virtually simultaneously. Detonation of the perforating shaped charges occurs at approximately 110 milliseconds after ignition of gas generating unit and that from a period of about 110 milliseconds to 200 milliseconds a substantial portion of the total flow through the perforations is gas generated by gas generating unit.

U.S. Pat. No. 4,391,337 to Ford et al. discloses an integrated jet perforation and controlled propellant fracture device and method for enhancing production in oil or gas wells. A canister contains a plurality of shaped charge grenades around which is packed a gas propellant material so as to form a solid fuel pack.

U.S. Pat. No. 5,355,802 to Petijean describes a method and apparatus for perforating a formation surrounding a wellbore and Initiating and propagating a fracture In the formation to stimulate hydrocarbon production from the wellbore. A tool includes at least one oriented shaped charge which is connected to detonator via a firing cord. At least one propellant generating cartridge is also positioned within tool and is connected to wireline cable through delay box via wires and cord.

U.S. Pat. No. 4,253,523 to Ibsen discloses a method and apparatus for well perforations and fracturing operations. A perforating gun assembly is comprised of a plurality of shaped charges positioned in spaced-apart relationship to each other in an elongated cylindrical carrier. The spaces in the carrier between the shaped charges are filled with a secondary explosive, such as an activated ammonium nitrate.

U.S. Pat. No. 5,005,641 to Mohaupt discloses a gas generating tool for generate a large quantity of high pressure gases to stimulate a subterranean formation. The tool comprises a carrier or frame having a series of staggered openings spaced longitudinally along the tubular member. Carrier receives a charge of propellant material which has a passage through which an ignition tube is inserted.

However, none of these prior art devices which utilized propellants in conjunction with perforating devices have proved to provide completely satisfactory results. Thus, a need exists for an apparatus and method for perforating and stimulating a subterranean formation which provides for improved communication between the wellbore and the subterranean formation penetrated thereby.

Thus, it is an object of the present Invention to provide an apparatus and method for perforating and stimulating a subterranean formation which provides for improved communication between the wellbore and the subterranean formation penetrated thereby.

It is also object of the present invention to provide an apparatus for perforating and stimulating a subterranean formation which is relatively simple in design and can be readily employed with a variety of perforating gun designs.

It is a further object of the present invention to provide an apparatus for perforating and stimulating a subterranean formation which provides repeatable burns of the propellant component of the apparatus.

It is still a further object of the present Invention to provide an apparatus for perforating and stimulating a subterranean formation which uses perforating charges of lesser energy than previously employed.

It is a still further object of the present invention to provide an apparatus and method for perforating and stimulating a subterranean formation wherein propellant is positioned between a perforating charge and the casing of a well bore.

SUMMARY OF THE INVENTION

To achieve the foregoing and other objects, and in accordance with the purposes of the present invention, as embodied and broadly described herein, one characterization of the present invention comprises an apparatus for perforating and stimulating a subterranean formation which is penetrated by a well bore having casing positioned therein so as to establish fluid communication between the formation and the well bore. The apparatus comprises one or more explosive charges, propellant interposed between the casing and at least one of the one or more explosive charges, and a detonator ballistically connected to the one or more charges.

Another characterization of the present invention comprises an apparatus for perforating a subterranean formation comprising an apparatus for perforating and stimulating a subterranean formation which is penetrated by a well bore having casing positioned therein so as to establish fluid communication between the formation and the well bore. The apparatus comprises a tube having one or more apertures therethrough, one or more shaped charges positioned within the tube, and propellant interposed between the casing and at least one of the one or more shaped charges. Each of the one or more shaped charges is aligned with one of the one or more apertures.

Yet another characterization of the present invention comprises a method of a method of perforating and stimulating a subterranean formation which is penetrated by a well bore having casing positioned therein so as to establish fluid communication between the formation and the well bore. In accordance with the method, a liquid propellant is positioned between at least one perforating charge in the well bore and the casing. The at least one perforating charge is detonated so as to form perforations through the casing and into the formation. Detonation of the perforating charge ignites the liquid propellant thereby forming gases which clean the perforations and extend fluid communication between the formation and the well bore.

A further characterization of the present invention is a kit for an apparatus for perforating and stimulating a subterranean formation which is penetrated by a well bore having casing positioned therein so as to establish fluid communication between the formation and the well bore. The kit comprises an apparatus for perforating a subterranean formation which has one or more shaped charges and a propellant adapted to interposed at least one of the shaped charges and the casing when the apparatus is positioned within the well bore.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DESCRIPTION OF THE PREFERRED EMBODIMENTS

Figure 1:
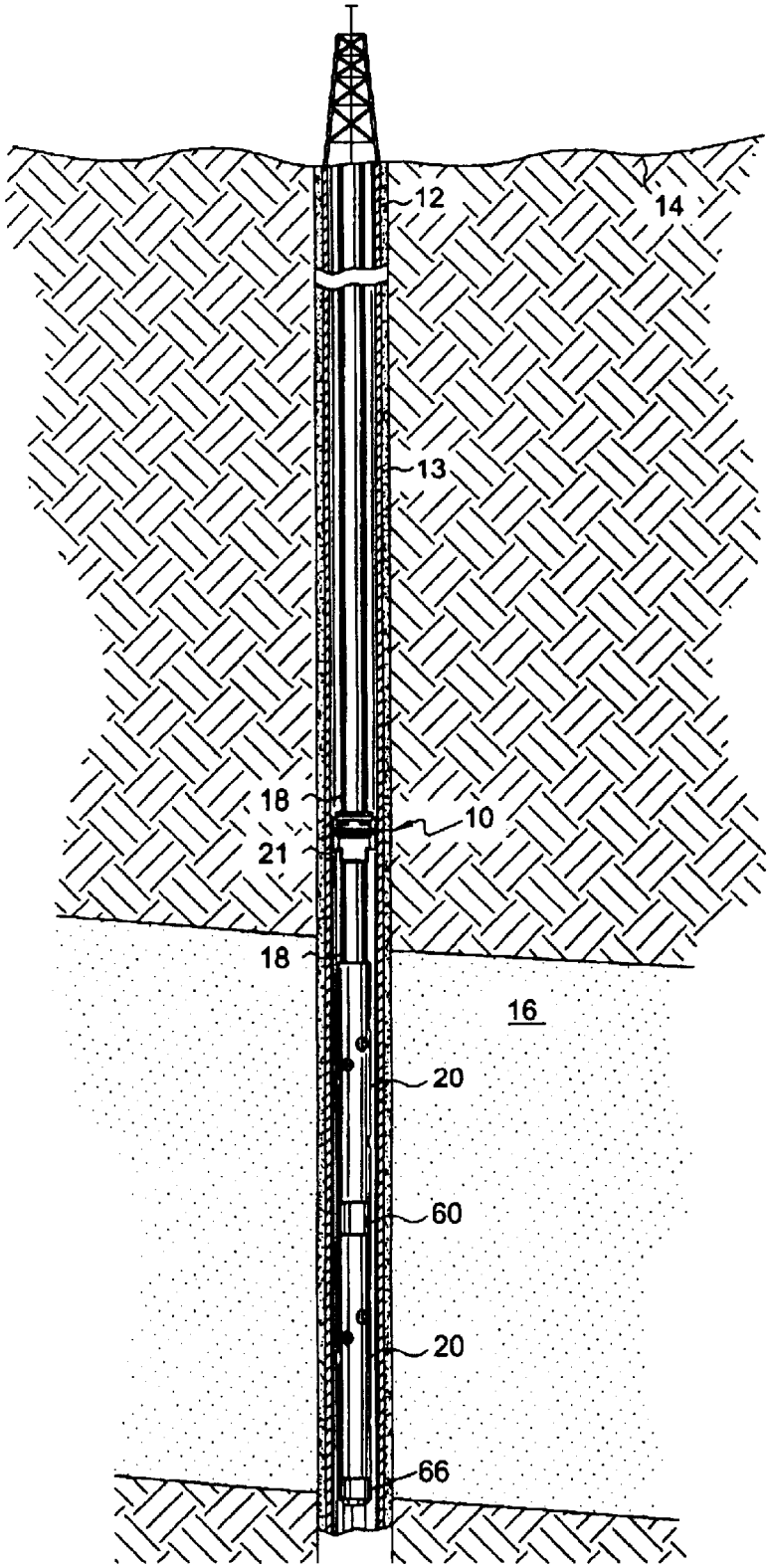
FIG. 1 is a cross sectional view of the apparatus of the present invention as positioned within a well penetrating a subterranean formation.

As illustrated in FIG. 1, a well 10 having a casing 12 which is secured therein by means of cement 13 extends from the surface of the earth 14 at least into a subterranean formation 16. One or more perforating and propellant apparatus 20 of the present invention are secured to the lower end of tubing string 18 and lowered into well 10. The upper most apparatus 20 as positioned within well 10 may be secured directly to the end of tubing string 18. A tandem sub 60 may be utilized to secure apparatus 20 together while a bull plug 66 may be secured to the terminal end of the lowermost apparatus 20. Any suitable means, such as a packer 21, may be employed to isolate the portion of well 10 adjacent interval 16, if desired. A tubing string may be utilized to position and support the apparatus of the present invention within a well bore. Tubing will preferably be employed to convey several apparatus 20 into the same well bore. Alternatively, a wireline, slick line, coil tubing or any other suitable means as will be evident to a skilled artisan may be used to position and support one or more apparatus 20 within a well bore.

Figure 2:
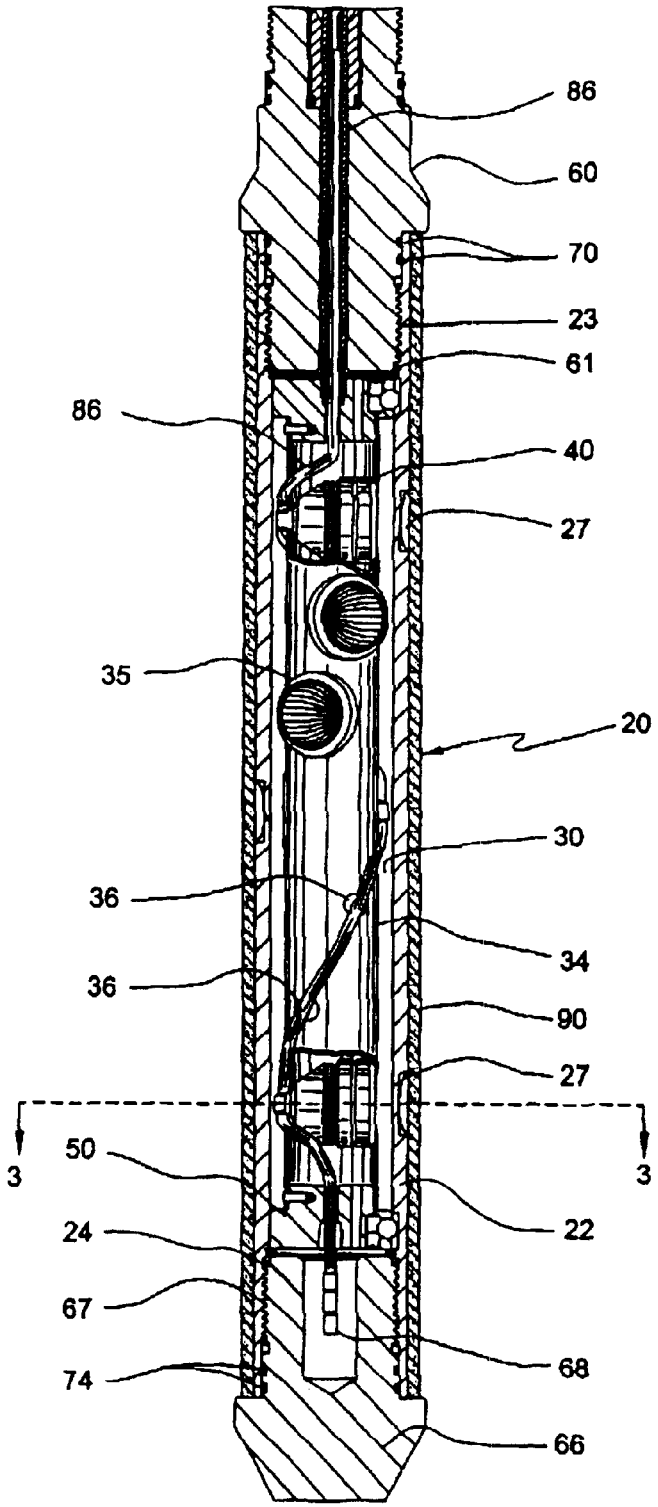
FIG. 2 is a cross sectional view of the apparatus of one embodiment of the present invention.

Referring now to FIG. 2, the perforating and propellant apparatus of the present invention is illustrated generally as 20 and has one end thereof secured to a tandem sub 60 while the other end thereof is secured to a bull plug 66. A perforating charge carrier 22 is positioned between tandem sub 60 and bull plug 66 and is secured thereto by any suitable means, such as by mating screw threads 23 and 24 which are provided In the internal surface of carrier 22 adjacent each end thereof with corresponding threads 61 and 67 of tandem sub 60 and bull plug 66, respectively. O-rings 70 provide a fluid tight seal between carrier 22 and tandem sub 60 while O-rings 74 provide a fluid tight seal between carrier 22 and bull plug 66. Carrier 22 may be a commercially available carrier for perforating charges and contains at least one conventional perforating charge 40 capable of creating an aperture in the carrier wall 30, well casing 12, and a portion of the adjacent subterranean formation 16. A perforating charge tube 34 is positioned within carrier 22 and has at least one relatively large aperture or opening 35 and a plurality of smaller apertures or openings 36 therein. Openings 35 in the wall of charge tube 34 may be spaced both vertically along and angularly about the axis of the tube. Charge carrier 22 and perforating charge tube 34 have generally elongated tubular configurations. A lined perforating charge 40 has a small end 46 secured in an aperture or opening 36 in perforating charge tube 34, as described below, and a large end 48 aligned with and protruding through opening or aperture 35 in tube 34. At least one lined perforating charge 40 is mounted In perforating charge tube 34. A detonating cord 86 is connected to a detonator above tandem sub 60, to the small end 46 of each perforating charge 40, and to end cap 68 in bull plug 66. One or more additional combinations of a perforating charge carrier, booster transfer and a tandem sub could be mounted above carrier 22. Tube alignment end plates 50 function to align charge tube 34 within carrier 22 so that the front of each charge is adjacent a scallop 27 in the wall of carrier 22.

If multiple charges are present, they may be spaced vertically along and angularly about the axis of the carrier. The charge density is an appropriate density determined by methods known to those skilled in the art. Common charge densities range between two and twenty four per foot. Detonating cord 86 connects a booster transfer (not illustrated) in tandem sub 60 above carrier 22, all charges 40, and end cap 68 in bull plug 66.

Figure 3:
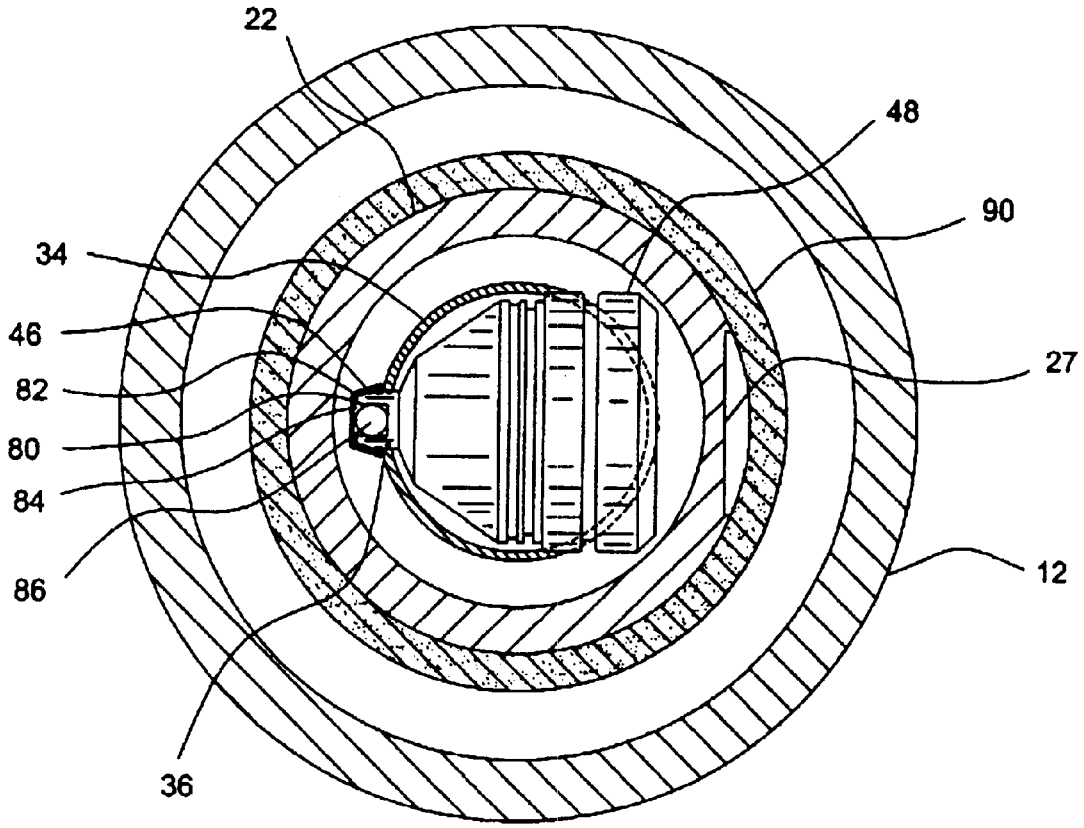
FIG. 3 is a cross sectional view illustrating the spatial relationships between the certain component parts of the apparatus of the present invention taken along line 3—3 of FIG. 2.

As illustrated in FIG. 3, brackets 80 on the small end 46 of lined perforating charge 40 extend through opening 36 in charge tube 34. A clip 82 secures punch charge 40 to charge tube 34. Detonating cord 86 is threaded through a space 84 between brackets 80 and clip 82. Charge tube 34 is mounted in carrier 22 so that the small end 46 of charge 40 is adjacent scallop 27 in carrier 22.

Figure 4:
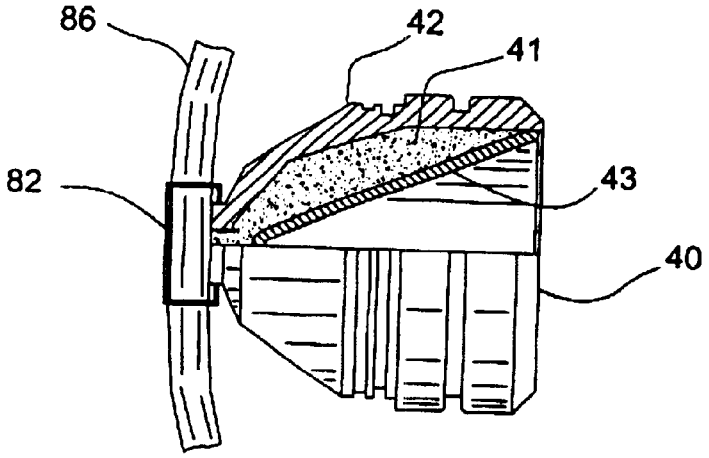
FIG. 4 is a partial cross sectional view of a perforating charge as connected to a detonating cord.

Referring to FIG. 4, a typical perforating charge is illustrated generally as 40. A highly compressed explosive 41 partially fills perforating charge case 42. Liner 43 covers the exposed surface of the explosive. The liner 43 is commonly metallic and serves to focus the energy of the charge and enable the charge to perforate a well casing.

Figure 5:
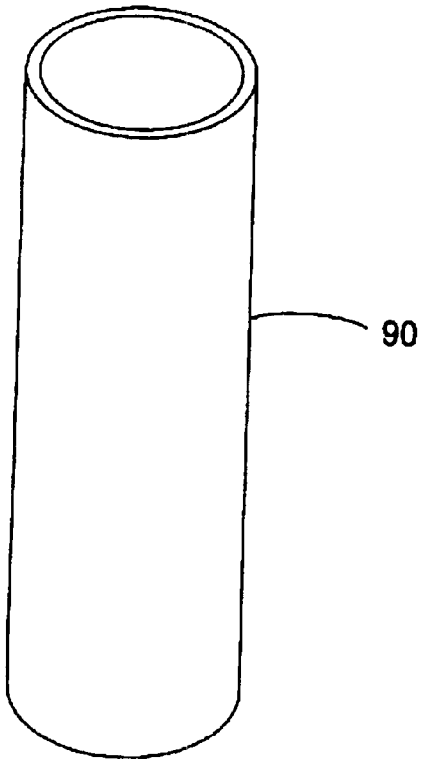
FIG. 5 is a perspective view of one embodiment of the propellant sleeve of the apparatus of the present invention which is illustrated in FIG. 2.

In accordance with the present invention, a sleeve 90 which has a generally tubular configuration (FIG. 5) is positioned around perforating charge carrier 22 during manufacture of the perforating and propellant apparatus 20 of the present invention or during final assembly thereof which may take place at the well site. As assembled (FIG. 2), sleeve 90 is secured in positioned around perforating charge carrier 22 at one end by tandem sub 60 and by bull plug 66 at the other end. Tandem sub 60 and bull plug 66 may be sized to have an external diameter greater than sleeve 90 so as to inhibit damage to sleeve 90 during positioning within a well bore. Alternatively, protective rings or the like (not illustrated) which have a larger external diameter than sleeve 90 may be inserted between tandem sub 60, bull plug 66 and sleeve 90 during manufacture or final assembly of the apparatus of the present invention so as to inhibit damage to sleeve 90. Sleeve 90 may extend the entire distance between tandem sub 60 and bull plug 66 or a portion thereof. Sleeve 90 is constructed of a water repellant or water proof propellant material which is not physically effected by hydrostatic pressures commonly observed during perforation of a subterranean formation(s) and is unreactive or inert to almost all fluids, in particular those fluids encountered in a subterranean well bore. Preferably, the propellant is a cured epoxy or plastic having an oxidizer incorporated therein such as that commercially available from HTH Technical Services, Inc. of Coeur d'Alene, Id.

Figure 6:
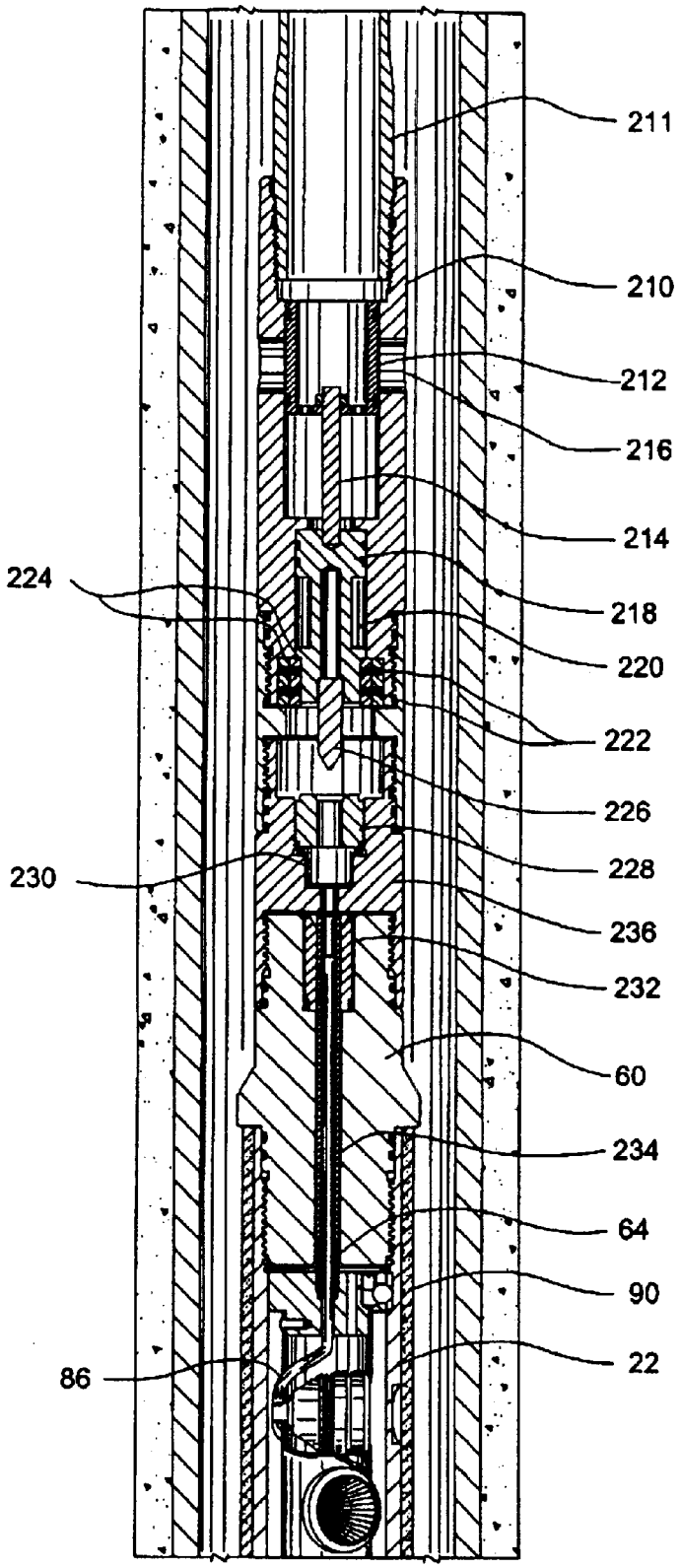
FIG. 6 is a cross section of a portion of a detonating system suitable for use in the present invention.

Any suitable detonating system may be used in conjunction with the perforating and propellant apparatus 20 of the present invention as will be evident to a skilled artisan. An example of such a suitable detonating system suitable is illustrated in FIG. 6. Vent housing 210 is capable of attachment to the end of a tubing string 211 or wireline (not shown). A vent 212 is attached to connecting rod 214 inside vent housing 210 and seals fluid passage 216. Rod 214 is in contact with a piston 218. An annular chamber 220 between piston 218 and the interior wall of housing 210 is filled with air at atmospheric pressure. Adjacent the bottom of piston 218, shear pins 222 are mounted in shear set 224, and a firing pin 226 extends downward from the bottom of piston 218. Retainer 228 joins vent housing 200 and tandem sub 60. Percussion detonator 230 is mounted in retainer 228 in firing head 236 which is attached to vent housing 210 and capable of attachment to tandem sub 60. Sub 60 is attached to perforating charge carrier 22. An ignition transfer 232 at the top of sub 60 is in contact with detonating cord 86 passing through central channel 234 and charge carrier 22, as described above. A booster transfer is located in each tandem sub 60, linking the detonating cords in the charge carriers above and below the tandem sub.

Upon application of sufficient hydraulic pressure to the top of piston 218, vent 212 and piston 218 simultaneously move downward, opening fluid passage 214 and causing firing pin 226 to contact percussion detonator 230. The ignition of percussion detonator 230 causes a secondary detonation in ignition transfer 232, which in turn ignites detonating cord 86. Detonating cord 86 comprises an explosive and runs between the ends of each charge carrier, passing between the backs of the charges and the charge clips holding the charges in the carrier. Cord 86 ignites the shaped charges 40 in charge carrier 22 and booster transfer, which contains a higher grade explosive than detonating cord 86.

As described above and shown in FIG. 6, an impact detonator provides a primary detonation. If the perforating apparatus is run on a wireline, the primary detonator could, alternatively, be an electrical detonator. The primary detonator ignites a pressure-sensitive chemical in ignition transfer 232, which in turn ignites detonating cord. The detonating cord then ignites the one or more charges 40 in the carrier 22 simultaneously. Each transfer booster also contains an explosive for detonating the cord 86 in the adjacent carrier. The system may be detonated from the top, the bottom, or both.

In operation, the desired number of perforating charge carriers 22 are loaded with charges 40 and are connected with a detonating means, such as detonating cord 86. A string of apparatus 20 separated by tandem subs 60 is assembled at the well site as the units are lowered into well 10 at the end of a tubing string, wireline, slick line, coil tubing or any other suitable means as will be evident to a skilled artisan. Propellant sleeve 90 may be cut from a length of propellant tubular and positioned around perforating charge carrier 22 at the well site. The apparatus 20 is then located in the well with the perforating charges adjacent the formation interval 16 to be perforated. The perforating charges 40 are then detonated. Upon detonation, each perforating charge 40 blasts through a scallop 27 in carrier 32, penetrates propellant sleeve 90, creates an opening in casing 12 and penetrates formation 16 forming perforations therein. Propellant sleeve 90 breaks apart and ignites due to the shock, heat, and pressure of the detonated shaped charge 40. When one or more perforating charges penetrate the formation, pressurized gas generated from the burning of propellant sleeve 90 enters formation 16 through the recently formed perforations thereby cleaning such perforations of debris. These propellant gases also stimulate formation 16 by extending the connectivity of formation 16 with well 10 by means of the pressure of the propellant gases fracturing the formation.

A proppant, such as sand, may be introduced into well 10 almost simultaneously with the ignition of the perforation and propellant apparatus 20 of the present invention by any of a variety of suitable means, such as a conventional perforating charge carrier which is equipped with punch charges, filled with sand and connected in series to detonating cord 86, as is commercially available under the trademark POWR*PERF from Halliburton Energy Services or Advance Completion Technologies Inc. As such gases generated by burning propellant sleeve 90 escape from the well and enter the perforations formed in formation 16, the sand which is carried into the fractures by the propellant gases abrades or scours the walls of the perforations and fractures, thereby enlarging the conduits for fluid flow between the formation and the well 10. Some of the sand may remain in the fractures as a proppant, thereby preventing the fractures from closing when the fluid pressure is relieved.

Figure 7:
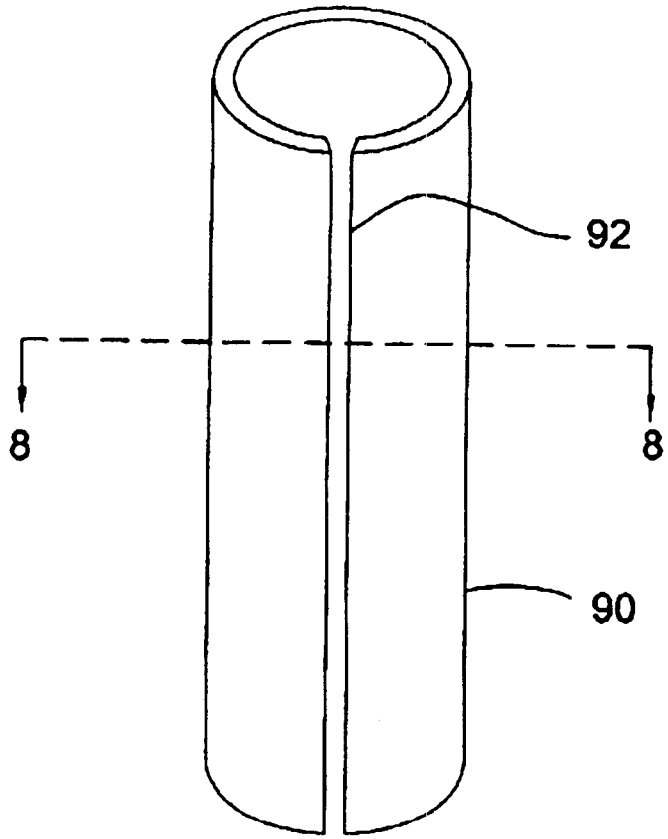
FIG. 7 is a perspective view of another embodiment of the propellant sleeve of the apparatus of the present invention which is illustrated in FIG. 2.
Figure 8:
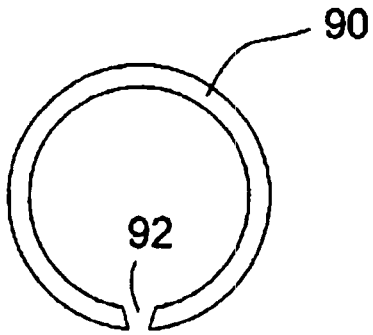
FIG. 8 is a cross sectional view of the propellant sleeve taken along line 8—8 of FIG. 7.
Figure 9:
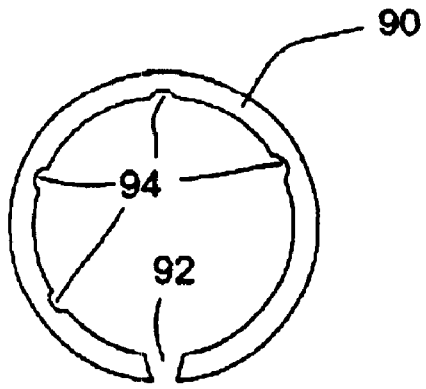
FIG. 9 is a cross sectional view of another embodiment of a propellant sleeve utilized in the apparatus of the present invention which is illustrated in FIG. 2.
Figure 10:
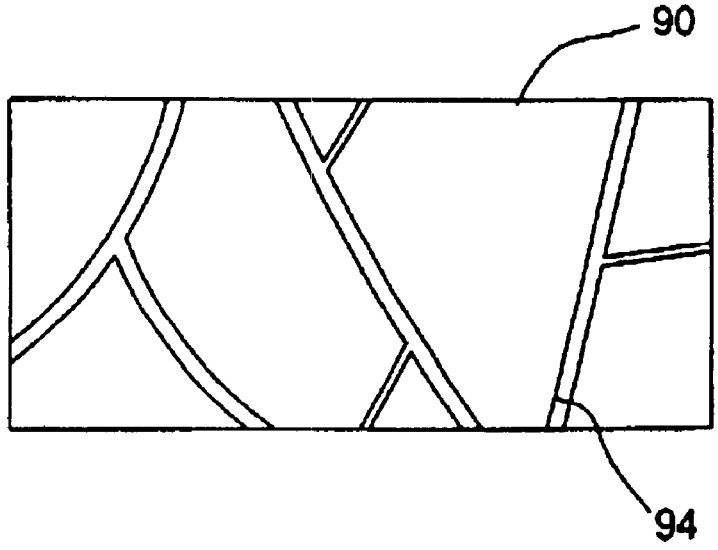
FIG. 10 is a cutaway view of the propellant sleeve embodiment depicted in FIG. 9 which illustrates the interior wall of the sleeve.

To assist in Ignition, sleeve 90 may be provided with one or more grooves or slits 92 which may extend through the entire thickness of sleeve 90 (FIG. 7) and which may extend substantially the entire length thereof. The slit(s) is positioned adjacent a shaped charge 40 such that upon ignition shaped charge 40 impacts slit 92 which provides a greater surface area for sleeve 90 to ignite and bum. Preferably, slit(s) 92 is tapered (FIG. 8) such that the slit is wider at the internal surface of sleeve 90 than the external surface thereof. To achieve a uniform and repeatable burn, the internal surface of sleeve 90 may be provided with grooves or channels 94 (FIGS. 9 and 10) to assist in propellant sleeve 90 uniformly breaking upon being impacted by shaped charge 40. Grooves or channels 94 may have a varied or a uniform thickness or depth and may be formed in a uniform or random patten.

Figure 11:
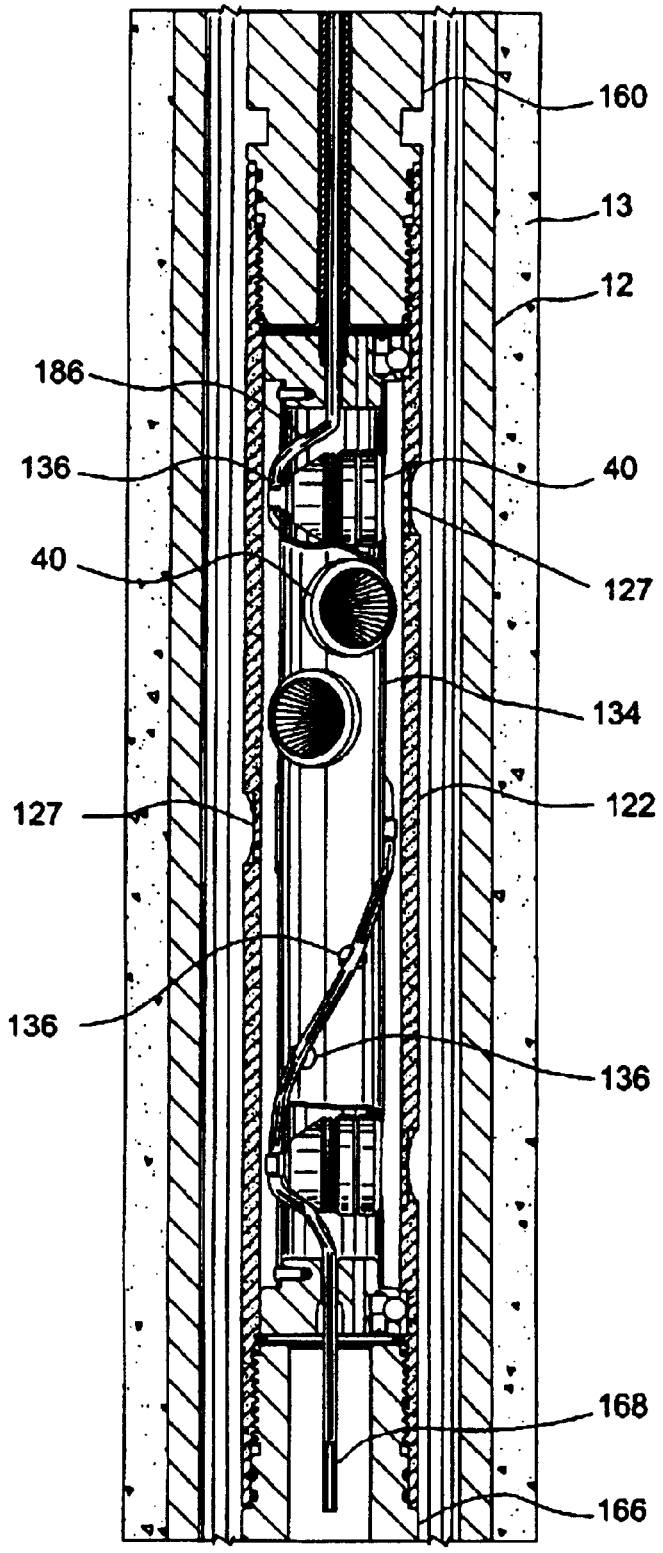
FIG. 11 is a cross sectional view of another embodiment of the apparatus of the present invention.

Referring now to FIG. 11, another embodiment of the perforating and propellant apparatus of the present invention is illustrated generally as 120 and has a perforating charge carrier 122 is located between two tandem subs 160 or between a tandem sub 160 and bull plug 166. In this embodiment, carrier 122 is constructed of a water repellant or proof propellant material which is not physically effected by hydrostatic pressures commonly observed during perforation or subterranean formations and is unreactive or inert to almost all fluids, in particular those fluids encountered in a subterranean well bore. Preferably, the propellant is a cured epoxy, carbon fiber composite having an oxidizer incorporated therein such as that commercially available from HTH Technical Services, Inc. of Coeur d'Alene, Idaho. Carrier 122 contains at least one conventional perforating charge 140 capable of creating an aperture in the carrier wall 130, well casing 12, and a portion of the interval 16 in the adjacent subterranean formation. Each perforating charge 140 is secured in an opening 136 in perforating charge tube 134 with a clip. Preferably, tandem sub 160, bull plug 166 and charge tube 134 are constructed of a material which substantially entirely breaks up or decomposes, for example thin walled steel, a material which substantially disintegrates, for example a carbon fiber, epoxy composite, upon detonation of charges 140, or a material which is completely burnable, such as a epoxy, oxidizer propellant similar to that used for sleeve 90. If more than one shaped charges is utilized, they may be spaced vertically along and angularly about the axis of the carrier. The charge density is an appropriate density determined by methods known to those skilled in the art. Common charge densities range between six and twelve per foot. Detonating cord 186 connects a booster transfer in tandem sub 160 above carrier 122, all charges 40, and end cap 168 in bull plug 166. As previously discussed with respect to the embodiment illustrated in FIG. 2, one or more combinations of an additional tandem sub and an additional perforating charge carrier could be mounted below carrier 122. The detonating cord 186 would then be connected to a booster transfer in the tandem sub 160 below each additional perforating charge carrier. In this embodiment, removal of any portion of the gun from well 10 after detonation is obviated since the carrier is Ignited and the charge tube decomposed and/or disintegrated upon detonation of charge(s) 140. This advantage is especially pronounced in instances where a very small amount of space, if any, exists below the interval of formation 16 which is perforated.

Figure 12:
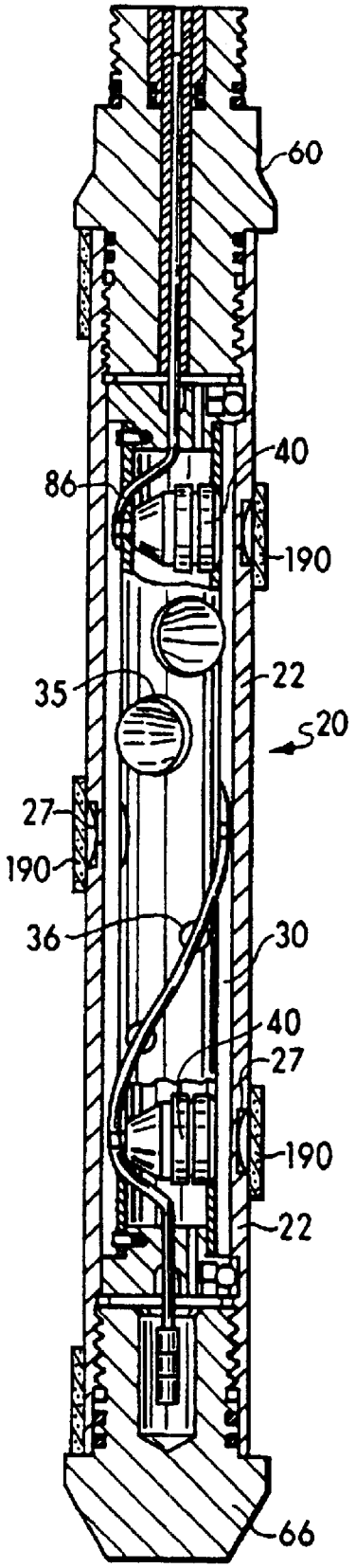
FIG. 12 is a cross sectional view of the another embodiment of the propellant as utilized in conjunction with the apparatus of the present invention.
Figure 13:
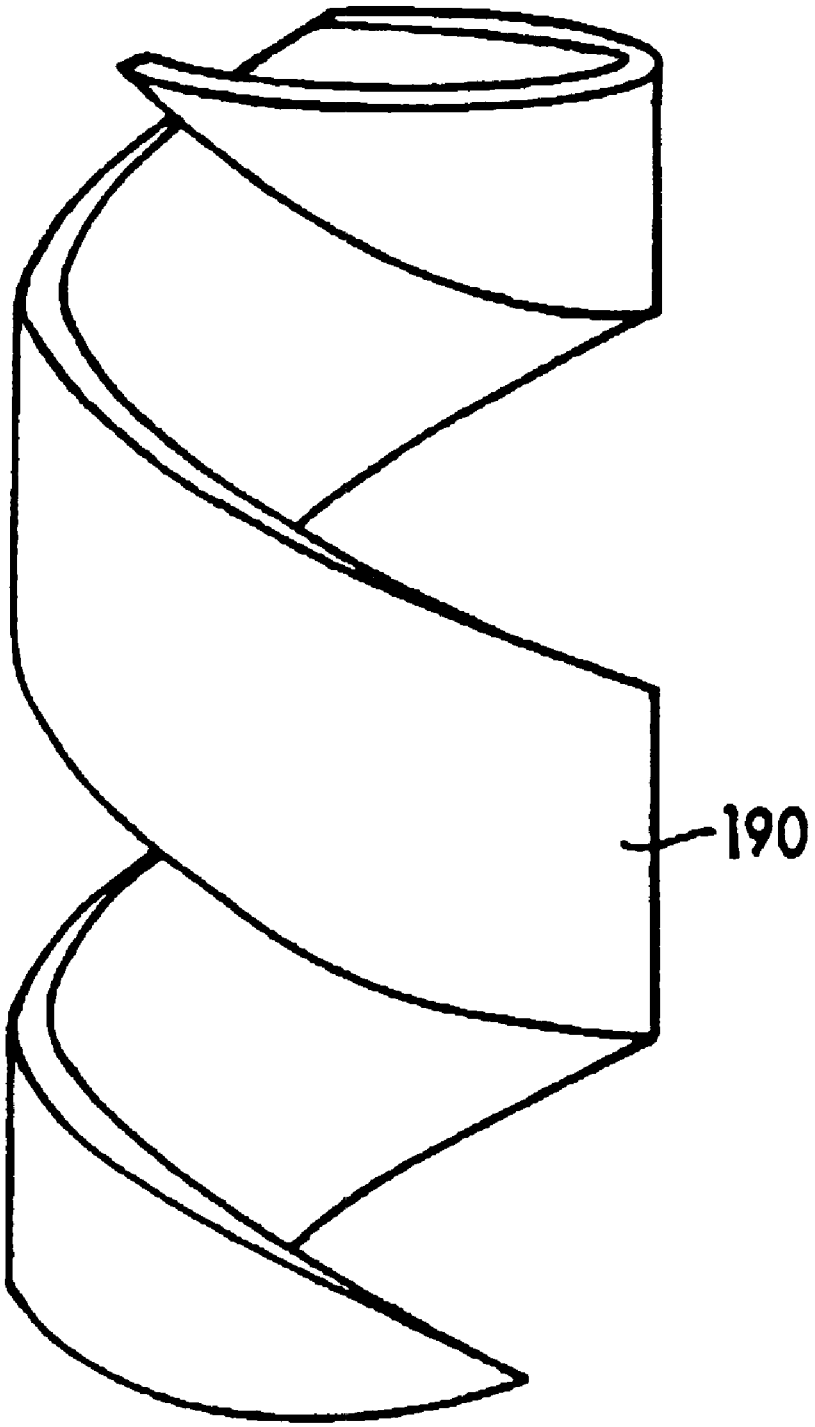
FIG. 13 is a perspective view of the embodiment of propellant utilized in conjunction with the apparatus of the present invention which is also illustrated in FIG. 12.

Although the propellant as utilized in the present invention is described above as being a sleeve, shell or sheath which is generally rigid, the propellant may utilized in different shapes, configurations and/or forms so long as propellant is interposed casing which is positioned within a subterranean well bore and at least one perforating charge which is positioned within the casing. For example, propellant 190 as illustrated in FIG. 13 may be substantially helical or spiral in form and is positioned around perforating charge carrier 22 during manufacture of the perforating and propellant apparatus 20 of the present invention or during final assembly thereof which may take place at the well site. As assembled (FIG. 12), propellant 190 is secured in positioned around perforating charge carrier 22 at one end by tandem sub 60 and by bull plug 66 at the other end. Tandem sub 60 and bull plug 66 may be sized to have an external diameter greater than sleeve 90 so as to inhibit damage to propellant 190 during positioning within a well bore. Alternatively, protective rings or the like (not illustrated) which have a larger external diameter than propellant 190 may be inserted between tandem sub 60, bull plug 66 and propellant 190 during manufacture or final assembly of the apparatus of the present invention so as to inhibit damage to propellant 190. Propellant 190 may extend the entire distance between tandem sub 60 and bull plug 66 or a portion thereof. As with sleeve 90, propellant 190 is constructed of a water repellant or water proof propellant material which is not physically effected by hydrostatic pressures commonly observed during perforation of a subterranean formation(s) and is unreactive or inert to almost all fluids, in particular those fluids encountered in a subterranean well bore. Preferably, the propellant is a cured epoxy or plastic having an oxidizer incorporated therein such as that commercially available from HTH Technical Services, Inc. of Coeur d'Alene, Idaho. Alternatively, propellant 190 may be in the form of one or more bands or in the form of one or more generally linear or generally arcuate strips which are positioned about charge carrier 22 so as to be interposed at least one perforating charge 40 and casing 12. The bands of propellant 190 may be generally annular and may have gap therein so as to be U-shaped or C-shaped in cross section. As another example, propellant 190 may be flexible and wrapped about all or a portion of charge carrier 22 in any shape or pattern so as to be interposed at least one perforating charge 40 and casing 12. In both of these embodiments, propellant 190 may be secured to charge carrier by any suitable means as will be evident to a skilled artisan, such as a commercially available adhesive. Pursuant to a further alterative, propellant 190 is a relatively thin, discrete shape having any suitable peripheral configuration, for example polygonal or a closed plane curve such as a circle, and is secured to the outer surface of charge carrier 22 by any suitable means, for example adhesive or screw threads, so as to be interposed at least one perforating charge 40 and casing 12.

Figure 14:
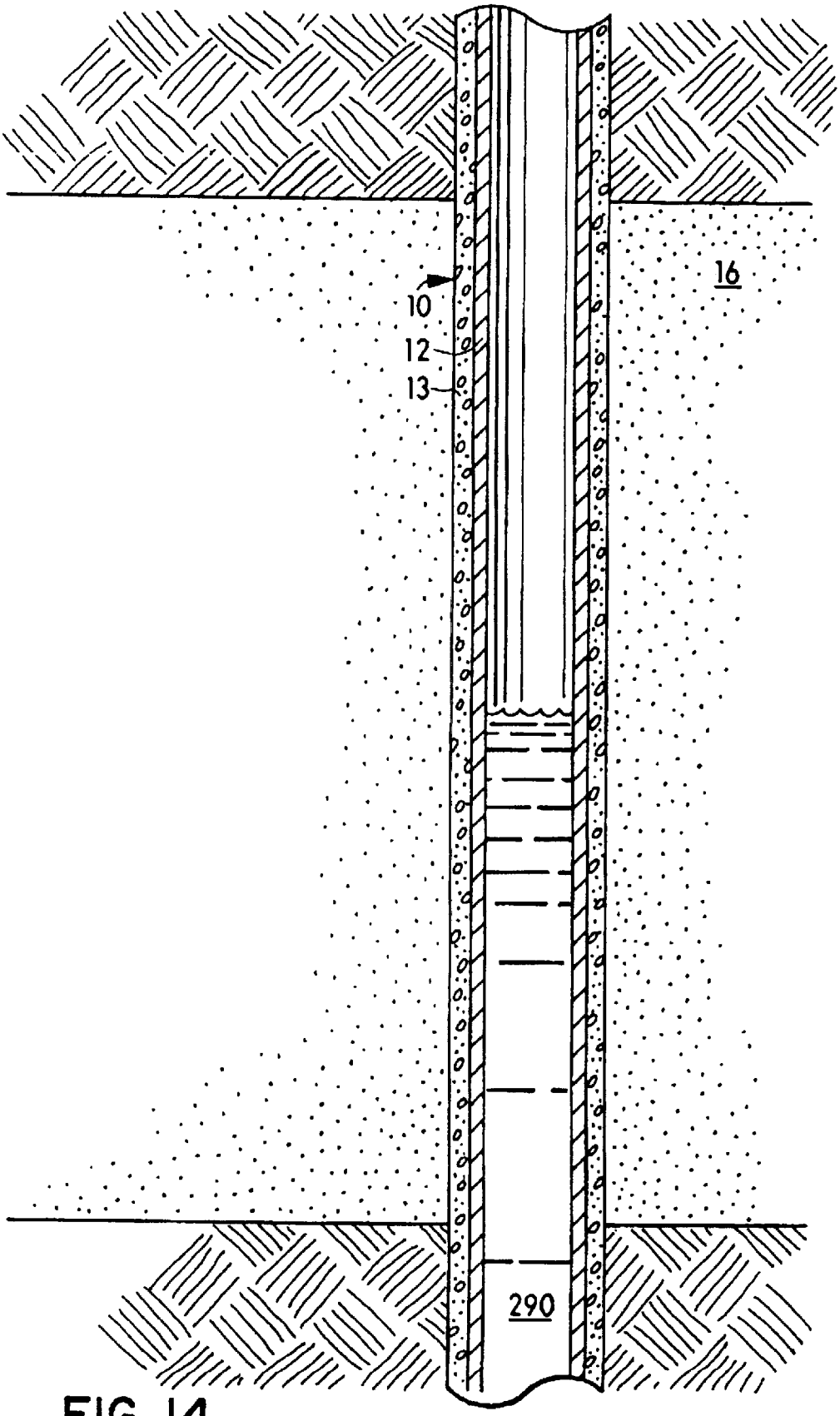
FIG. 14 is a schematic view of another embodiment of the present invention in which liquid propellant is introduced Into a subterranean well bore.
Figure 15:
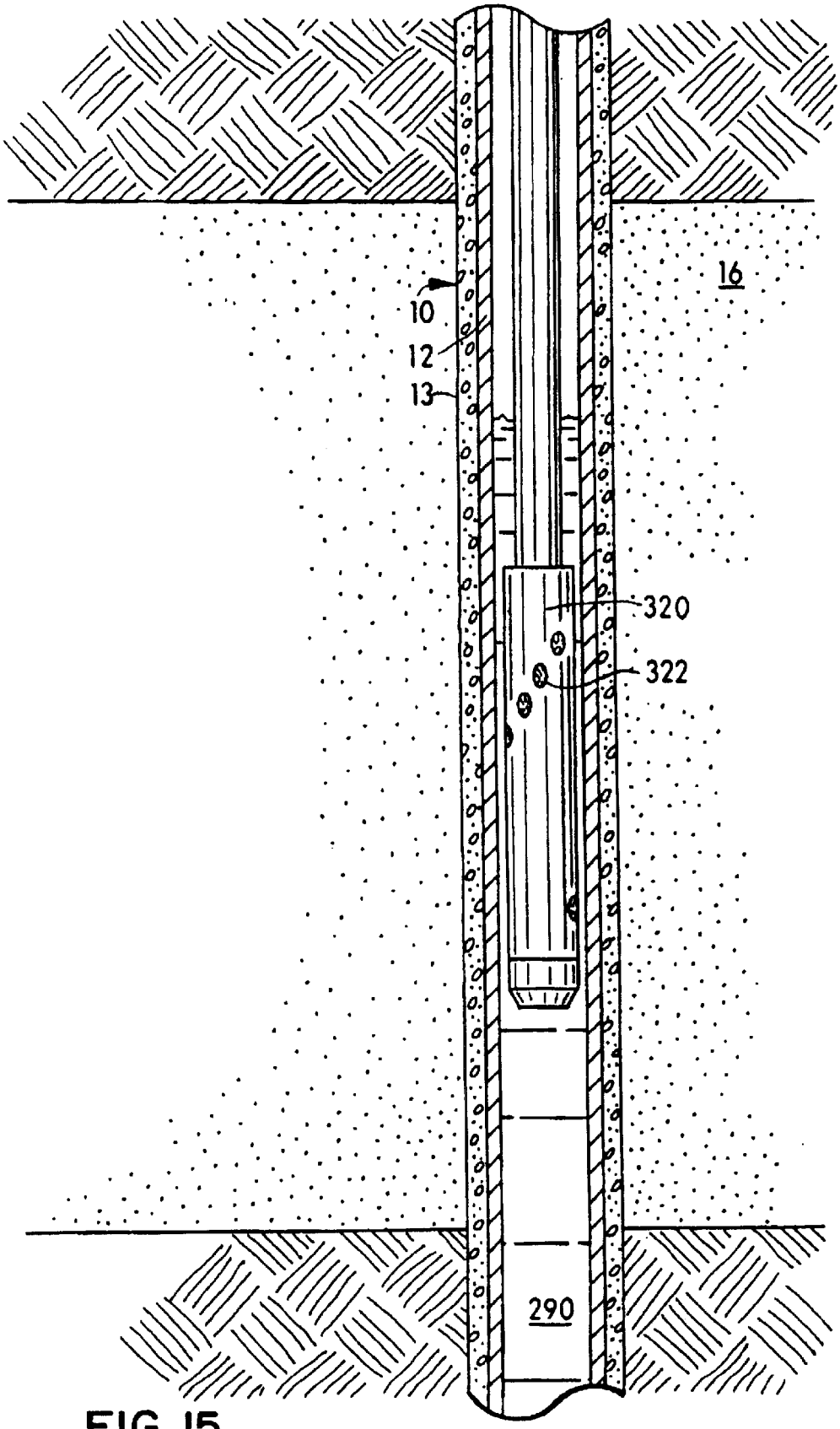
FIG. 15 is a schematic view of the embodiment illustrated in FIG. 15 further illustrating a perforating gun being positioned within the liquid propellant in a subterranean well bore.

In yet another embodiment of the present invention, a liquid propellant 290, such as that manufactured under the trade name designation Re-flo 403 by Hercules, Inc. of Wilmington, Delaware, is injected into well 10 via casing 12 and forms a first upper liquid surface 291 within well 10. One or more conventional perforating guns 320 are then lowered into well 10 at the end of a tubing string, wireline, slick line, coil tubing or any other suitable means as will be evident to a skilled artisan. The perforating guns are positioned adjacent the subterranean formation of interest which is formation 16 as illustrated in FIG. 14. As thus positioned, the liquid propellant previously injected into well 10 is displaced by the perforating gun(s) 320 such that the liquid propellant is interposed at least the lowermost perforating charge 322 present in the lowermost perforating gun 320. Preferably, the volume of liquid propellant 290 previously injected into well 10 is sufficient to cover all of the perforating charges in every perforating gun 320 lowered into well 10. As displaced about the perforating gun(s) 320, the liquid propellant forms a second upper liquid surface charges 322 are then detonated by means of a suitable detonating system as previously described. Upon detonation, each perforating charge 322 penetrates liquid propellant 290, creates an opening in casing 12 and penetrates formation 16 forming perforations therein. The liquid propellant 290 ignites due to the shock, heat, and pressure of the detonated shaped charge(s) 322. When one or more perforating charges penetrate the formation, pressurized gas generated from the burning of liquid propellant 290 enters formation 16 through the recently formed perforations thereby cleaning such perforations of debris. These gases also stimulate formation 16 by extending the connectivity of formation 16 with well 10 by means of the pressure of the gases fracturing the formation. Alternatively, the liquid propellant may be injected into well 10 simultaneously with lowering of perforating gun 320 into the well or after perforating gun 320 is positioned within well 10.

The perforating and propellant apparatus of the present invention can be utilized with tubing or wireline. The increased strength of the tubing over wireline allows the use of a longer perforating and propellant apparatus, thereby allowing a longer interval to be perforated and stimulated in a single trip into a well. A tubing conveyed apparatus is also compatible with the use of packers to isolate one or more portions of the well adjacent one or more intervals of the formation. Thus, the method may be used where it is desired for some other reason to limit the pressure to which another portion of the well is subjected, for example, in a well where one or more other zones have already been completed. Further, if the well has a high deviation angle from vertical or is horizontal, the tubing may be used to push the perforating and propellant apparatus into the well.

Multiple intervals of a subterranean formation can be perforated and fractured in a single operation by combining two or more perforating and propellant apparatus 20 and/or 120 of the present invention with a single tubing string in a spaced apart manner as will be evident to a skilled artisan. In using the perforating and propellant apparatus of the present invention, shaped charges containing a smaller amount of highly compressed explosive than conventional charges may be employed since the shaped charge need only perforate casing 12 as gases which are generated by burning propellant extend the perforation and fractures into the subterranean formation. Accordingly, a greater number of shaped charges may be employed in the apparatus of the present invention than in a conventional perforating apparatus and/or shaped charges which produce larger diameter perforations than those produced by conventional shaped charges may be employed in the apparatus of the present invention. Further, propellant sleeve 90 or carrier 122 may have proppant dispersed throughout or embedded upon the outer surface thereof. This proppant may also contain a radioactive tag to assist in determining the dispersion of the proppant into the perforations in the subterranean formation (s).

Although the various embodiments of the apparatus of the present invention have been described and illustrated as being comprised of several component parts which are secured together in a fluid tight relationship, it is within the scope of the present invention to construct the apparatus 20 or 120 of an integral piece of propellant material which is open to flow of fluids from the well bore and in which shaped charges are secured.

As discussed above, the ignition means may be a detonating material, such as detonating cord 28. Altematively, the ignition means may be a deflagrating material or cord. For example, a tube containing black powder may be utilized as the ignition system to ignite the propellant in the apparatus and method of the present invention.

While the foregoing preferred embodiments of the invention have been described and shown, it is understood that the alternatives and modifications, such as those suggested and others, may be made thereto and fall within the scope of the invention.

I claim:

1. An apparatus for perforating and stimulating a subterranean formation which is penetrated by a well bore having casing positioned therein so as to establish fluid communication between the formation and the well bore, said apparatus comprising:

one or more explosive charges;

a generally flexible propellant interposed said casing and at least one of said one or more explosive charges; and a detonator ballistically connected to said one or more charges.

2. The apparatus of claim 1 wherein said propellant has a generally helical configuration.

3. The apparatus of claim 1 herein said propellant is one or more strips.

4. The apparatus of claim 3 wherein said one or more strips are linear.

5. The apparatus of claim 4 wherein said one or more strips are arcuate.

6. The apparatus of claim 1 wherein said propellant has a polygonal configuration.

7. The apparatus of claim 1 wherein said propellant has a closed plane curve configuration.

8. The apparatus of claim 1 wherein said propellant is a liquid 12. The apparatus of claim 1 wherein said propellant is interposed said casing and all of said one or more explosive charges.

9. An apparatus for perforating and stimulating a subterranean formation which is penetrated by a well bore having casing positioned therein so as to establish fluid communication between the formation and the well bore, said apparatus comprising:

a tube having one or more apertures therethrough;

one or more shaped charges positioned within said tube, each of said one or more shaped charges being aligned with one of said one or more apertures; and a generally flexible propellant interposed said casing and at least one of said one or more shaped charges.

10. The apparatus of claim 9 wherein said propellant has a generally helical configuration.

11. The apparatus of claim 9 wherein said propellant is one or more strips.

12. The apparatus of claim 11 wherein said one or more strips are linear.

13. The apparatus of claim 11 wherein said one or more strips are arcuate.

14. The apparatus of claim 9 wherein said propellant has a polygonal configuration.

15. The apparatus of claim 9 wherein said propellant has a closed plane curve configuration.

16. The apparatus of claim 9 wherein said propellant is a liquid 24. The apparatus of claim 13 wherein said propellant is interposed said casing and all of said one or more explosive charges.

17. The apparatus of claim 13 wherein said propellant is secured to the outer surface of said tube.

18. The apparatus of claim 9 wherein said propellant is water repellant or water proof, is not physically effected by hydrostatic pressures encountered in said subterranean formation and is unreactive or inert to fluids which may be encountered in a well penetrating and in fluid communication with said subterranean formation.

19. The apparatus of claim 9 wherein said propellant is a cured epoxy or plastic having an oxidizer incorporated therein.

20. A method of perforating and stimulating a subterranean formation which is penetrated by a well bore having casing positioned therein so as to establish fluid communication between the formation and the well bore, said method comprising:

placing a liquid propellant between at least one perforating charge in said well bore and said casing; and detonating said at least one perforating charge so as to form perforations through said casing and into said formation, said detonation of said perforating charge igniting said liquid propellant thereby forming gases which clean said perforations and which extend fluid communication between said formation and said well bore.

21. The method of claim 20 wherein said step of placing comprises injecting liquid propellant into said well bore before said at least one perforating charge is positioned within the well bore.

22. The method of claim 20 wherein said step of placing comprises injecting liquid propellant into said well bore simultaneous with positioning said at least one perforating charge within the well bore.

23. A kit for an apparatus for perforating and stimulating a subterranean formation which is penetrated by a well bore having casing positioned therein so as to establish fluid communication between the formation and the well bore, said kit comprising:

an apparatus for perforating a subterranean formation which has one or more shaped charges; and a generally flexible propellant adapted to be interposed a casing which is positioned within a well bore penetrating a subterranean formation and at least one of said one or more shaped charges when said apparatus is placed within said well bore.

24. The kit of claim 23 wherein said propellant has a generally helical configuration.

25. The kit of claim 23 wherein said propellant is one or more strips.

26. The kit of claim 25 wherein said one or more strips are linear.

27. The kit of claim 25 wherein said one or more strips are arcuate.

28. The kit of claim 25 wherein said propellant has a polygonal configuration.

29. The kit of claim 25 wherein said propellant has a closed plane curve configuration.

30. The kit of claim 25 wherein said propellant is a liquid.

* * * * *